US011111758B2

(12) United States Patent
Oprea

(10) Patent No.: US 11,111,758 B2
(45) Date of Patent: Sep. 7, 2021

(54) DOWNHOLE SLEEVE TOOL

(71) Applicant: The WellBoss Company, Inc., Calgary (CA)

(72) Inventor: Adrian Oprea, Calgary (CA)

(73) Assignee: The WellBoss Company, Inc.

( * ) Notice: Subject to any disclaimer, the term of this patent is extended or adjusted under 35 U.S.C. 154(b) by 30 days.

(21) Appl. No.: 16/750,407

(22) Filed: Jan. 23, 2020

(65) Prior Publication Data

US 2020/0240241 A1 Jul. 30, 2020

Related U.S. Application Data

(60) Provisional application No. 62/796,256, filed on Jan. 24, 2019.

(51) Int. Cl.

| | |
|---|---|
| ***E21B 34/10*** | (2006.01) |
| ***E21B 34/14*** | (2006.01) |
| ***E21B 34/06*** | (2006.01) |
| *E21B 43/26* | (2006.01) |

(52) U.S. Cl.

CPC ..... *E21B 34/103* (2013.01); *E21B 34/063* (2013.01); *E21B 34/10* (2013.01); *E21B 34/14* (2013.01); *E21B 43/26* (2013.01); *E21B 2200/06* (2020.05)

(58) Field of Classification Search

CPC ..... E21B 34/103; E21B 34/14; E21B 34/125; E21B 34/063

See application file for complete search history.

(56) References Cited

U.S. PATENT DOCUMENTS

| | | | | |
|---|---|---|---|---|
| 6,227,298 | B1 * | 5/2001 | Patel | E21B 23/006 166/321 |
| 8,672,036 | B2 | 3/2014 | Hughes et al. | |
| 9,500,063 | B2 | 11/2016 | Greenan | |
| 9,556,714 | B2 | 1/2017 | Hughes et al. | |
| 9,995,111 | B2 | 6/2018 | Hughes et al. | |
| 10,156,124 | B2 | 12/2018 | Guzman et al. | |
| 2003/0183398 | A1 * | 10/2003 | Smith | E21B 34/103 166/387 |
| 2012/0279722 | A1 * | 11/2012 | Murray | E21B 34/103 166/373 |
| 2013/0299200 | A1 | 11/2013 | Hughes et al. | |
| 2014/0238689 | A1 | 8/2014 | Hughes et al. | |
| 2015/0041148 | A1 * | 2/2015 | Greenan | E21B 34/103 166/374 |
| 2015/0114718 | A1 | 4/2015 | Hughes et al. | |
| 2015/0330185 | A1 | 11/2015 | Hughes et al. | |
| 2015/0337624 | A1 * | 11/2015 | Themig | E21B 33/146 166/285 |

(Continued)

*Primary Examiner* — Frederick L Lagman

(74) *Attorney, Agent, or Firm* — Rao DeBoer Osterrieder, PLLC; John M. DeBoer

(57) ABSTRACT

A downhole sleeve tool is provided that includes a lower sub defining a central bore and one or more sleeve ports therethrough. There is a piston valve slidably positionable within the lower sub to selectively block communication between the central bore and the one or more sleeve ports. There is an upper sub connectable to the lower sub and sharing another central bore therewith. The upper sub has an inlet port, one or more communication ports, and an outlet port. There is an at least one cartridge assembly disposed in a cartridge bore formed in a wall of the upper sub.

20 Claims, 16 Drawing Sheets

(56) References Cited

U.S. PATENT DOCUMENTS

| | | | | |
|---|---|---|---|---|
| 2016/0265310 | A1* | 9/2016 | Getzlaf | E21B 34/103 |
| 2016/0298404 | A1 | 10/2016 | Beckett et al. | |
| 2017/0051574 | A1 | 2/2017 | Hughes et al. | |
| 2017/0204700 | A1 | 7/2017 | Hughes et al. | |
| 2018/0038221 | A1 | 2/2018 | Hughes et al. | |
| 2018/0148992 | A1* | 5/2018 | Vasques | E21B 23/06 |
| 2018/0238137 | A1 | 8/2018 | Hughes et al. | |
| 2018/0238142 | A1 | 8/2018 | Hughes et al. | |
| 2020/0173245 | A1* | 6/2020 | Prasad | E21B 23/06 |

* cited by examiner

DOWNHOLE SLEEVE TOOL

CROSS-REFERENCE TO RELATED APPLICATIONS

This application claims priority to U.S. Provisional Patent Application Ser. No. 62/796,256, filed on Jan. 24, 2019. The disclosure of said application(s) is hereby incorporated herein by reference in entirety for all purposes.

STATEMENT REGARDING FEDERALLY SPONSORED RESEARCH OR DEVELOPMENT

Not applicable.

BACKGROUND

Field of the Disclosure

The present disclosure relates generally to a downhole tool for use in a wellbore. Some embodiments pertain to a testable initiator sleeve for use in a workstring.

Background of the Disclosure

An oil or gas well includes a wellbore extending into a subterranean formation at some depth below a surface (e.g., Earth's surface), and is usually lined with a tubular, such as casing, to add strength to the well.

Production treatment or stimulation of the formation may be necessary to fracture the formation and provide passage of hydrocarbons to the wellbore, from which it can be brought to the surface and produced. Fracturing of formations via horizontal wellbores traditionally involves pumping a stimulant fluid through either a cased or open hole section of the wellbore and into the formation to fracture the formation and produce hydrocarbons therefrom.

In some circumstances frac strings are deployed in cased wellbores, in which case perforations are provided in the cemented in system to allow stimulation fluids to travel through the fracing tool and the perforated cemented casing to stimulate the formation beyond. In other cases, fracing is conducted in uncased, open holes.

In the case of multistage fracing, multiple frac valve tools are used in a sequential order to frac sections of the formation, typically starting at a toe end of the wellbore and moving progressively towards a heel end of the wellbore. A toe valve is a particular valve located at the toe end of a frac string. It is the first valve on the string to open and to allow communication between an interior of the frac string and the formation beyond.

Toe valves, also called toe-initiator sleeves are sometimes designed to open only after a specific number of pressure cycles at specific values have been applied. Once opened, the flow path can be used to either stimulate the formation for production or simply to allow the multistage frac bottom hole assembly (BHA) of choice to be pumped downhole. The completion string can be cemented or not inside the well-bore.

Some toe valves, such as that taught in U.S. Pat. No. 9,752,412 use an indexing mechanism in the form of a pin-and groove arrangement formed on an outer surface of an inner tubular, and a piston system that allows fluid to move the indexing pin downhole in a pressure test and a biasing device to move the indexing mechanism back uphole when the pressure test is over, and the pin-and-groove arrangement prevents fluid pressure from opening the valve until a predetermined number of pressure tests are complete.

U.S. Pat. No. 9,500,063 teaches a toe valve having a port sleeve that is situated in and shifts between an outer mandrel and an inner mandrel. A valve collar has four ports: a cycling port, an actuating port, an output port and an opening port. In a pressure test, fluid is applied through the cycling port to an uphole end of a cartridge to push the cartridge downhole. A spring biases the cartridge back uphole at which point fluid is passes through the actuating port to providing fluid communication downstream to either a next cartridge or to shift the piston valve. A locking rod including at least one locking feature is positioned to retainer the first piston valve in the open position once opened.

There is a need is a downhole tool or device suitable to provide multi-cycle operability.

SUMMARY

Embodiments of the disclosure pertain to a downhole sleeve tool that may include one or more of: a lower sub defining a central bore and one or more sleeve ports therethrough; a piston valve slidably positionable within the lower sub to selectively block communication between the central bore and the one or more sleeve ports; an upper sub connectable to the lower sub and sharing a central bore therewith, said upper sub defining an inlet port, one or more communication ports and an outlet port and comprising one or more cartridge assemblies each housed in a cartridge bore formed in a wall of the upper sub.

Any of such cartridge assemblies may include one or more of: a spring rod axially fixed in the cartridge bore; a cartridge sleeve slidably positioned on at least a portion of the spring rod; a spring positioned around the spring rod; a break pin insertable into at least a portion of the cartridge sleeve and enagable with the spring rod to thereby axially fix the cartridge sleeve and hold the spring in compression between the spring rod and the cartridge sleeve.

Breakage of the break pin by fluid pressure from the central bore and release of fluid pressure may allow extension of the spring and axial movement of the cartridge sleeve, allowing passage of fluid to one or more subsequent cartridge assemblies via a communications port, or allows passage of fluid to an uphole end of the piston valve to thereby shift the valve to allow communication between the central bore and the one or more sleeve ports.

Other embodiments herein pertain to a method of opening a downhole sleeve tool. The method may include the step of providing a downhole sleeve tool. The sleeve tool may include one or more of: a lower sub defining a central bore and one or more sleeve ports therethrough; a piston valve slidably positionable within the lower sub to selectively block communication between the central bore and the one or more sleeve ports; an upper sub connectable to the lower sub and sharing a central bore therewith, said upper sub defining an inlet port, one or more communication ports and an outlet port and comprising one or more cartridge assemblies each housed in a cartridge bore formed in a wall of the upper sub.

Any of said cartridge assemblies may include a spring rod axially fixed in the cartridge bore; a cartridge sleeve slidably positioned on at least a portion of the spring rod; a spring positioned around the spring rod; a break pin insertable into at least a portion of the cartridge sleeve and enagable with the spring rod to thereby axially fix the cartridge sleeve and hold the spring in compression between the spring rod and the cartridge sleeve.

The method may include the step of pressurizing a first cartridge of said downhole tool to break said break pin with fluid pressure from the central bore; releasing fluid pressure to allow extension of the spring and axial movement of the cartridge sleeve; allowing passage of fluid to one or more subsequent cartridge assemblies via a communications port, or allowing passage of fluid to an uphole end of the piston valve to thereby shift the valve to allow communication between the central bore and the one or more sleeve ports.

Other embodiments of the disclosure pertain to a downhole sleeve tool that may include a lower sub coupled with an upper sub. The lower sub may include a (central) bore therethrough. The lower sub may have an at least one sleeve port. There may a movable member operable with the lower sub and/or the upper sub. In aspects, there may be a piston valve slidably positionable within the lower sub to selectively block fluid communication (fluid flow) between the bore of the lower sub and the one or more sleeve ports.

The upper sub may include an at least one fluid communication port; and an outlet port. The supper sub may have a sidewall. There may be a cartridge bore formed within the sidewall. There may be a cartridge assembly disposed within the cartridge bore.

The cartridge assembly may include one or more of: a spring rod; a cartridge sleeve (movably) positioned on an at least a portion of the spring rod; a bias member engaged with the cartridge sleeve; and a break pin comprising a pin working surface. The break pin may be disposed within at least a portion of the cartridge sleeve. The break pin may be engaged with the spring rod. The break pin may be configured to break from application of a pressure (such as from a fluid) against the pin working surface.

The downhole sleeve tool may include a second cartridge assembly. In aspects, the fluid may enter the second cartridge assembly after the bias member moves the cartridge sleeve to a retracted or second position. An at least one of the cartridge assembly and the second cartridge assembly may have a longitudinal cartridge axis. The downhole sleeve tool may have a respective longitudinal sleeve axis. The longitudinal cartridge axis may be (substantially) orthogonal to the longitudinal sleeve axis. Orthogonal is meant to include a reasonable tolerance for precision, but need not be exactly mathematical orthogonal.

The downhole sleeve tool may include a flow control insert. The flow control insert may include an inner radial ridge. The inner radial ridge may include a longitudinal ridge height. In aspects, a portion of the piston valve may be configured to at least partially block the at least one sleeve port when an end of the piston valve is engaged with an end of the inner radial ridge. A blocking ratio of the longitudinal ridge height to a height of the portion is in a ratio range of 0.8 to 1.2. The ratio may be about 1.

The downhole tool sleeve may include an upper atmospheric chamber proximate an uphole end of the piston valve. The upper atmospheric chamber may be in fluid communication with the outlet port. The piston valve may be hydraulically balanced until the upper atmospheric chamber is pressurized with fluid transferred from the outlet port. In aspects, the fluid may enter a pressure chamber of the cartridge from the inlet port in order to act on the pin working surface. The pressure chamber may be sealingly isolated from fluid communication with any other part of the cartridge bore until the break pin breaks.

In embodiments, release or reduction of fluid pressure in the pressure chamber may allow for extension or decompression of the bias member, and resultant movement of the cartridge sleeve to the retracted position. Movement of the cartridge sleeve may facilitate the shift of one or more seals between the pressure chamber and a spring atmospheric chamber to thereby allow fluid flow from the pressure chamber to the spring atmospheric chamber, and then to at least one of: a subsequent cartridge assemblies via a communications port, and to the uphole end of the piston valve.

The downhole sleeve tool may include a retention plate to axially fix the spring rod in the cartridge assembly. The break pin may be formed with a break diameter at which it breaks, and wherein the break pin threadingly engaged to the spring rod in an assembled, unactivated configuration.

Upon breakage of the break pin, a first break pin remnant may remain engaged with the spring rod. A second break pin remnant and the cartridge sleeve may be movable (together or separately) into a break pin atmospheric chamber. One or more seals or o-rings on the cartridge sleeve may be configured to prevent fluid pressure from entering break pin atmospheric chamber.

Embodiments herein pertain to a method of opening a downhole sleeve tool. The method may include the step of providing a downhole sleeve tool configured with one or more of: a lower sub comprising: a central bore, and at least one lateral sleeve port; a piston valve slidably positionable within the lower sub to selectively block fluid communication between the central bore and the at least one sleeve port; an upper sub engaged with the lower sub, the upper sub comprising: an inlet port, an at least one communication port, an outlet port, and a cartridge bore formed in a sidewall of the upper sub; a cartridge assembly disposed and housed within the cartridge bore, the cartridge assembly comprising: a spring rod; a cartridge sleeve slidably positioned on at least a portion of the spring rod; a bias member engaged with the cartridge sleeve in a biased position; a break pin disposed in at least a portion of the cartridge sleeve, and engaged with the spring rod.

The method may include the step of pressurizing the cartridge bore in a sufficient manner to break the break pin with fluid pressure from the central bore; releasing fluid pressure from the cartridge bore to release the bias member from the biased position, and thereby allow the bias member to move the cartridge sleeve to a retracted position; after the releasing step, allowing passage of fluid from the cartridge bore to an at least one of: one or more subsequent cartridge assemblies via a communications port, and to an uphole end of the piston valve to thereby shift the piston valve away from selectively blocking the sleeve port in order to allow fluid communication between the central bore and the at least one sleeve port.

Yet other embodiments pertain to a downhole sleeve tool that may include a lower sub. The lower sub may have a (central) bore and one or more sleeve ports therethrough. There may be a piston valve movably (such as slidably) positionable within the lower sub to selectively block fluid communication between the bore and the one or more sleeve ports.

The sleeve tool may include upper sub connectable to the lower sub. The upper sub may have one or more of: an inlet port; an at least one fluid communication port; an outlet port; and a cartridge bore formed within a sidewall of the upper sub.

The sleeve tool may include a cartridge assembly disposed within the cartridge bore. The cartridge assembly may include any of: a spring rod; a cartridge sleeve movably positioned on at least a portion of the spring rod; a bias member engaged with the cartridge sleeve; a break pin disposed within at least a portion of the cartridge sleeve, and engaged with the spring rod.

In aspects, breakage of the break pin by fluid pressure from the bore of the lower sub or wellbore, and release of fluid pressure may allow extension or decompression of the bias member, and subsequent (axial) movement of the cartridge sleeve. The movement may provide to allow passage of fluid to one or more subsequent cartridge assemblies via a communications port, or passage of fluid to an uphole end of the piston valve to thereby shift the valve to allow communication between the central bore and the one or more sleeve ports.

The cartridge assembly may include a longitudinal cartridge axis. The downhole sleeve tool may have a longitudinal sleeve axis. The longitudinal cartridge axis may be orthogonal to the longitudinal sleeve axis. The downhole sleeve tool may include a flow control insert configured with an inner radial ridge having a longitudinal ridge height. In aspects, a portion of the piston valve may be configured to at least partially block the at least one sleeve port when an end of the piston valve is engaged with an end of the inner radial ridge.

These and other embodiments, features and advantages will be apparent in the following detailed description and drawings.

BRIEF DESCRIPTION OF THE DRAWINGS

For a more detailed description of the present disclosure, reference will now be made to the accompanying drawings, wherein.

DETAILED DESCRIPTION

Figure 1:
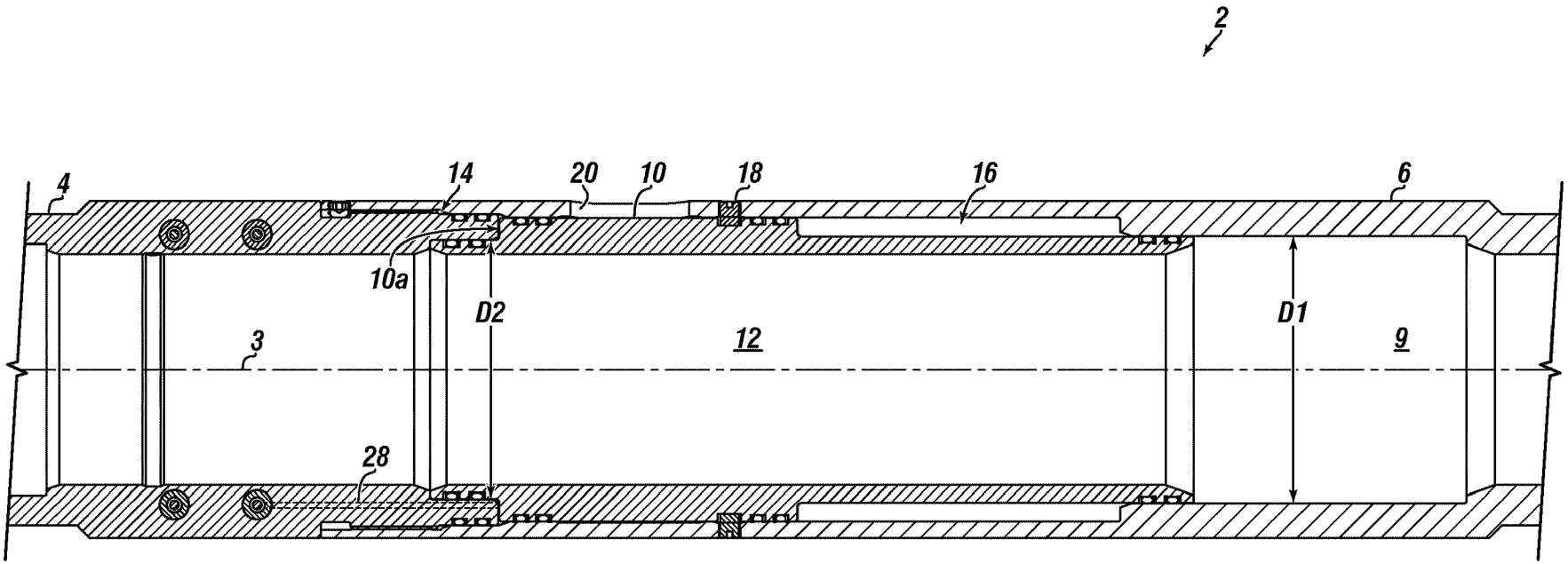
FIG. 1 shows a cross-sectional elevation view of an initiator sleeve, in a sleeve closed position, according to embodiments of the disclosure.

Herein disclosed are novel apparatuses, systems, and methods that pertain to downhole tools usable for wellbore operations, and aspects (including components) related thereto, the details of which are described herein.

Embodiments of the present disclosure are described in detail with reference to the accompanying Figures. In the following discussion and in the claims, the terms "including" and "comprising" are used in an open-ended fashion, such as to mean, for example, "including, but not limited to . . . ". While the disclosure may be described with reference to relevant apparatuses, systems, and methods, it should be understood that the disclosure is not limited to the specific embodiments shown or described. Rather, one skilled in the art will appreciate that a variety of configurations may be implemented in accordance with embodiments herein.

Although not necessary, like elements in the various figures may be denoted by like reference numerals for consistency and ease of understanding. Numerous specific details are set forth in order to provide a more thorough understanding of the disclosure; however, it will be apparent to one of ordinary skill in the art that the embodiments disclosed herein may be practiced without these specific details. In other instances, well-known features have not been described in detail to avoid unnecessarily complicating the description. Directional terms, such as "above," "below," "upper," "lower," "front," "back," "right", "left", "down", etc., may be used for convenience and to refer to general direction and/or orientation, and are only intended for illustrative purposes only, and not to limit the disclosure.

Connection(s), couplings, or other forms of contact between parts, components, and so forth may include conventional items, such as lubricant, additional sealing materials, such as a gasket between flanges, PTFE between threads, and the like. The make and manufacture of any particular component, subcomponent, etc., may be as would be apparent to one of skill in the art, such as molding, forming, press extrusion, machining, or additive manufacturing. Embodiments of the disclosure provide for one or more components to be new, used, and/or retrofitted.

Numerical ranges in this disclosure may be approximate, and thus may include values outside of the range unless otherwise indicated. Numerical ranges include all values from and including the expressed lower and the upper values, in increments of smaller units. As an example, if a compositional, physical or other property, such as, for example, molecular weight, viscosity, melt index, etc., is from 100 to 1,000, it is intended that all individual values, such as 100, 101, 102, etc., and sub ranges, such as 100 to 144, 155 to 170, 197 to 200, etc., are expressly enumerated. It is intended that decimals or fractions thereof be included. For ranges containing values which are less than one or containing fractional numbers greater than one (e.g., 1.1, 1.5, etc.), smaller units may be considered to be 0.0001, 0.001, 0.01, 0.1, etc. as appropriate. These are only examples of what is specifically intended, and all possible combinations of numerical values between the lowest value and the highest value enumerated, are to be considered to be expressly stated in this disclosure.

Embodiments herein may be described at the macro level, especially from an ornamental or visual appearance. Thus, a dimension, such as length, may be described as having a certain numerical unit, albeit with or without attribution of a particular significant figure. One of skill in the art would appreciate that the dimension of "2 centimeters" may not be exactly 2 centimeters, and that at the micro-level may deviate. Similarly, reference to a "uniform" dimension, such as thickness, need not refer to completely, exactly uniform. Thus, a uniform or equal thickness of "1 millimeter" may have discernable variation at the micro-level within a certain tolerance (e.g., 0.001 millimeter) related to imprecision in measuring and fabrication.

The drawings are not necessarily to scale and in some instances proportions may have been exaggerated in order to more clearly depict certain features.

Terms

The term "connected" as used herein may refer to a connection between a respective component (or subcomponent) and another component (or another subcomponent), which can be fixed, movable, direct, indirect, and analogous to engaged, coupled, disposed, etc., and can be by screw, nut/bolt, weld, and so forth. Any use of any form of the terms "connect", "engage", "couple", "attach", "mount", etc. or any other term describing an interaction between elements is not meant to limit the interaction to direct interaction between the elements and may also include indirect interaction between the elements described.

The term "fluid" as used herein may refer to a liquid, gas, slurry, multi-phase, etc. and is not limited to any particular type of fluid such as hydrocarbons.

The term "composition" or "composition of matter" as used herein may refer to one or more ingredients, components, constituents, etc. that make up a material (or material of construction). For example, a material may have a composition of matter. Similarly, a device may be made of a material having a composition of matter. The composition of matter may be derived from an initial composition. Composition may refer to a flow stream of one or more chemical components.

The term "chemical" as used herein may analogously mean or be interchangeable to material, chemical material, ingredient, component, chemical component, element, substance, compound, chemical compound, molecule(s), constituent, and so forth and vice versa. Any 'chemical' discussed in the present disclosure need not refer to a 100% pure chemical. For example, although 'water' may be thought of as H2O, one of skill would appreciate various ions, salts, minerals, impurities, and other substances (including at the ppb level) may be present in 'water'. A chemical may include all isomeric forms and vice versa (for example, "hexane", includes all isomers of hexane individually or collectively).

For some embodiments, a material of construction may include a composition of matter designed or otherwise having the inherent characteristic to react or change integrity or other physical attribute when exposed to certain wellbore conditions, such as a change in time, temperature, water, heat, pressure, solution, combinations thereof, etc. Heat may be present due to the temperature increase attributed to the natural temperature gradient of the earth, and water may already be present in existing wellbore fluids. The change in integrity may occur in a predetermined time period, which may vary from several minutes to several weeks. In aspects, the time period may be about 12 to about 36 hours.

The term "fracing" or "frac operation" as used herein may refer to fractionation of a downhole well that has already been drilled. The same may also be referred to and interchangeable with the terms facing operation, fractionation, hydrofracturing, hydrofracking, fracking, hydraulic fracturing, frac, and so on. A frac operation may be land or water based.

The present testable toe-initiator sleeve may be used as part of a completions string, in order to create a flow path for the fluid from inside the string to the formation outside (or vice versa), after a specific number of pressure cycle tests at specific values have been applied. Once opened, the flow path can be used to stimulate the formation for production.

With reference to the Figures, the present toe-initiator sleeve 2 can be divided into two main components, an upper sub 4 and a lower sub 6. The upper sub 4 may have hydraulic valving that by means of applied internal hydraulic pressure communicated via a series of communication ports to one or more cartridges 8A, 8B, etc, allows the toe-initiator 2 to cycle through a number of adjustable pressure cycles before it opens. The cartridge(s) 8A etc. may be held in place, such as via a retention plate 40 and respective fasteners 40A.

One or more sleeve ports 20 may be formed into the lower sub 6. A piston valve 10 may be located in an inner lower sub bore 9 of the lower sub 6, which may be a (primary) barrier for fluid from an inner sleeve bore 12 of the toe-initiator 2 to access the formation via sleeve ports 20. When the toe-initiator 2 is run-in, and during pressure testing, the piston valve 10 may be in a state of hydraulic balance. A difference in hydraulic areas may be provided between an uphole end of the piston valve 10, as seen by D2 and a downhole end of the piston valve 10, as seen by D1. This difference in hydraulic areas may facilitate or generate a positive force up-hole suitable to keep the piston valve 10 closed with fluid in the bore 12.

This equilibrium may be maintained as long as an upper atmospheric chamber 14 and a lower atmospheric chamber 16 are maintained free of fluid. To prevent the piston valve 10 from being shifted inadvertently one or more shear shrews 18 may be used to connect the piston valve 10 to the lower sub 6. The shear screws 18 may be sheared when the upper atmospheric chamber 14 is flooded with sufficient fluid, whereby force (pressure) acts on an uphole end 10*a* of the piston valve 10 to overcome (break, shear, etc.) the shear screws. Thereafter, the piston valve 10 may move (e.g., downhole), thereby opening (by no longer blocking) sleeve ports 20. Fluid may be transferred to the upper atmospheric chamber 14 through the hydraulic valving (see, e.g., FIGS. 2A/2B) of the upper sub 4.

Figure 2A:
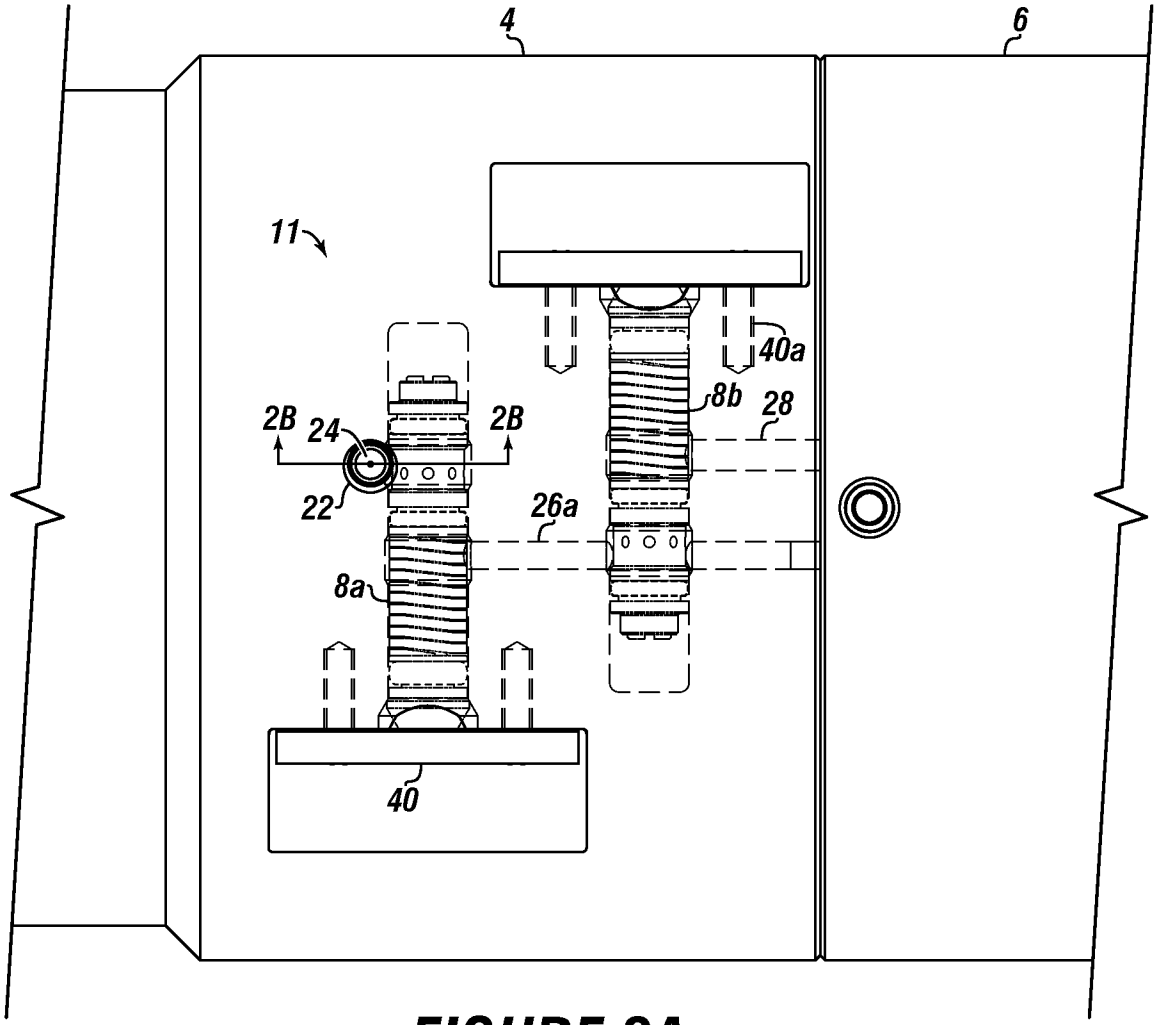
FIG. 2A shows a cross-sectional top view taken along line 2-2 of FIG. 1, depicting the upper sub of the initiator sleeve of FIG. 1, showing two cartridges, according to embodiments of the disclosure.
Figure 2B:
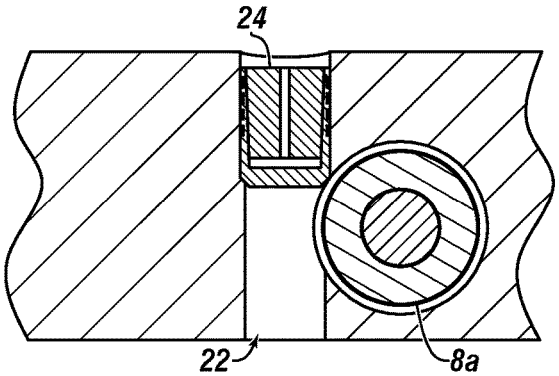
FIG. 2B shows a detailed cross-sectional elevation view taken along line B-B of FIG. 2A, depicting communication port A and a first stage cartridge, according to embodiments of the disclosure.

FIGS. 2A and 2B illustrate details of the upper sub 4 and hydraulic valving of the present toe initiator 2. The hydraulic valving assembly 11 may include one or more stages. Any such individual stage may have the exact same or comparable machined features, parts, and functionality, and may be connected (such as in series) by a number of communication ports.

FIGS. 2A and 2B together show a first stage may communicate (e.g., fluid communication) directly with the fluid inside the bore 12 of the toe initiator sleeve 2 via a hole cut through the upper sub 4 that forms a first communication port 22 (or sometimes may be referred to as inlet port 22). The first communication port 22 may optionally include a plug 24 disposed therein (via on an outer surface of the upper sub 4). The valve assembly 11 (via the communication port 22) may include a number of embodiments for controlling access to fluid into communication port 22, as discussed in relation to FIGS. 10 to 14 later herein.

After the first stage has been pressured up in a first pressure test or cycle, fluid may be allowed to travel to a next stage. The next stage may involve travel of fluid via a second communication port 26A to a second stage of pressure testing. Alternatively, the first stage or any stage may serve as the last stage after which pressurized fluid flows to access the upper atmospheric chamber 14 via a final communication port 28, also called an outlet port 28, and as such facilitate or trigger the shift or movement of the piston valve 10 into the open position. In FIGS. 2A and 2B, the fluid travels to a second stage via a second communication port 26A. A second pressure test is performed until the second stage is functioned, allowing fluid to move to the next stage.

Figure 3:
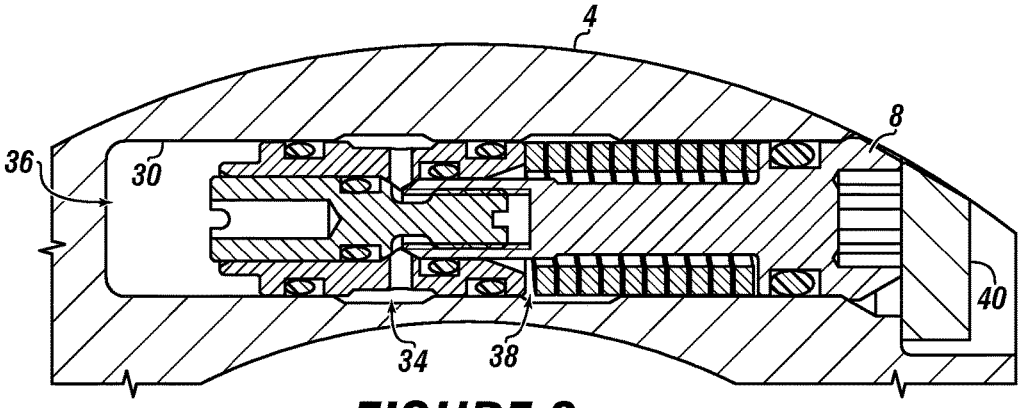
FIG. 3 shows a detailed cross-sectional side view taken along line 3-3 of FIG. 1, depicting a cross section of the upper sub with a cartridge, according to embodiments of the disclosure.

Referring now to FIG. 3, details are shown of one embodiment of one stage of the present toe initiator 2. The stage may include a valve assembly (11, FIG. 2A). The components and functionality of each stage may be exact or comparable. The arrangement and operation of cartridges 8A, 8B, 8C, etc. inside the upper sub 4 in relation to one other and in relation to the upper atmospheric chamber 14 may create or form an adjustable number of pressure cycles that may be used or applied to the toe initiator 2 prior to opening of the toe initiator 2. This is described in more detail herein.

Preferably, each stage may include a cartridge bore 30 formed inside the upper sub 4, and a cartridge assembly 8. In assembly, the cartridge 8 may be disposed (inserted) in the cartridge bore 30, and thereby form or create one or more sealed chambers. The cartridge bore 30 may be formed in a sidewall of the upper sub 4. The sealed chamber(s) may include a pressure chamber 34 and one or more atmospheric chambers. As shown here, there may be a first and second atmospheric chamber, namely, a break pin atmospheric chamber 36 and a spring atmospheric chamber 38. The atmospheric chambers 36, 38 may be separated or isolated by or from the pressure chamber 34.

A communication port (for example, FIGS. 2A-2B, port 22 or 26) may be in fluid communication with the pressure chamber 34, and may be configured to bring or facilitate introduction of pressurized fluid into the pressure chamber 34. In the case of the first stage, fluid may enter the pressure chamber 34 from a first communication port (22). In the case of any subsequent stages, fluid may be introduced into the pressure chamber 34 from subsequent communications ports (i.e., 26A, 26B, etc.), connecting earlier stages to subsequent stages.

The spring atmospheric chamber 38 of one stage may be in fluid communication with a pressure chamber 34 of a subsequent stage via a subsequent communications port 26A, 26B. Alternatively, in the case of a last stage, the spring atmospheric chamber 38 may be in fluid communication with the upper atmospheric chamber 14 via an outlet communications port (28, FIG. 2A). Established fluid communication of a spring atmospheric chamber of one stage with either the pressure chamber of the following stage or the atmospheric chamber 14 may allow for setting of the number of pressure cycles as may be desired.

A retention plate 40 may be installed or formed on an end of the cartridge 8 and assists in restricting movement of the cartridge 8. In an embodiment, the retention plate 40 may be a separate component that may be affixed to the upper sub 4 via one or more screws (40A, FIG. 2A), or other well known fasteners.

With reference now to FIGS. 4, 4A, 4B and 4C, further details of a cartridge assembly are provided, in accordance with embodiments herein. As shown, the cartridge assembly 8 may include a spring rod 42 with a cartridge sleeve 44 positioned movingly (e.g., slidingly) over at least a portion 42*a* of the spring rod 42. A suitable bias member may be disposed or located around the spring rod 42. While not limited, the bias member may be a spring 46. The spring 46 may be kept in a preloaded compressed (energized) state between an abutting end 42A of the spring rod 42 and an abutting opposite end 44A of the cartridge sleeve 44.

The cartridge sleeve 44 in turn may be held in place axially by a break pin 48. The break pin 48 may be inserted into the cartridge sleeve 44, and may have a pin shoulder 48A abut against an internal sleeve profile 44B of the cartridge sleeve 44. Pin 48 (such as via pin head 39) may be engaged with the spring rod 42. Engagement between the break pin 48 and the spring rod 42 may be via threaded connection 47. One or more seals 50 may be used to sealingly and fluidly isolate the pressure chamber 34 and two atmospheric chambers 36 and 38 (see also FIG. 3). In assembly, the break pin 48 may hold the sleeve 44 in place via engagement with the profile 44B, and the threaded engagement 47 (see mating threads 49A, 49B, FIG. 4A).

The cartridge 8 may have a longitudinal cartridge axis 13. In an analogous manner, the sleeve 2 may have a longitudinal axis 3. In an embodiment, the axes 3 and 13 may be generally parallel to each other. In other embodiments, the axes 3 and 13 may be offset. As shown here, the axis 3 may be contemplated as being orthogonal or perpendicular to each other (one of skill would appreciate the axes need not bisect).

In this respect, the cartridge 8 may be installed in a horizontal manner (orientation) with respect to the vertical nature of the sleeve 2 (or associated workstring). The use of a horizontal configuration may make it easier to insert or replace the cartridge without having to remove or disconnect portions of the workstring from one another.

Figure 4:
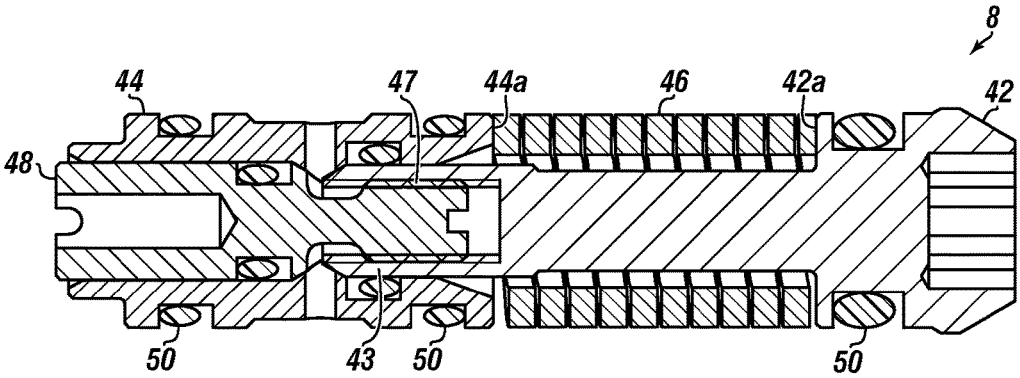
FIG. 4 shows a cross-sectional elevation view of a cartridge, according to embodiments of the disclosure.
Figure 4A:
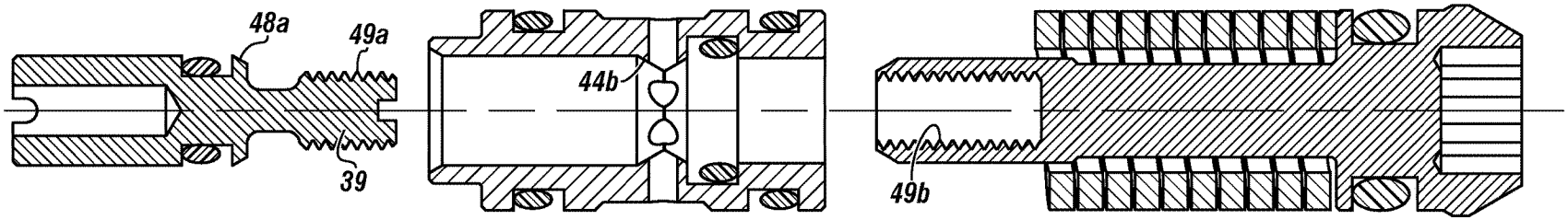
FIG. 4A shows a cross-sectional segmented elevation view of the cartridge of FIG. 4, according to embodiments of the disclosure.
Figure 4B:
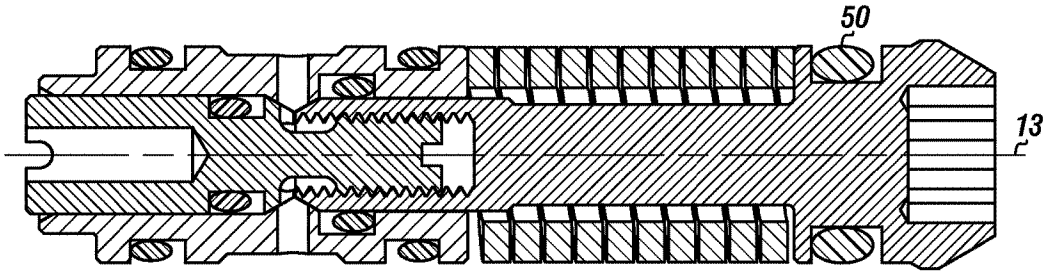
FIG. 4B shows a cross-sectional elevation view of the cartridge of FIG. 4, according to embodiments of the disclosure.
Figure 4C:
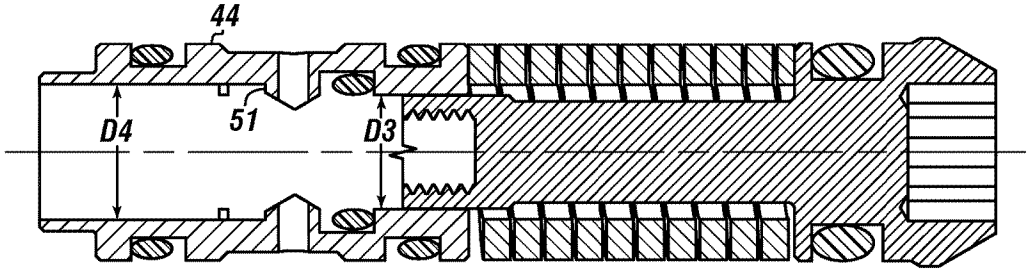
FIG. 4C shows a further cross-sectional view of the spring rod of the cartridge of FIG. 4, connected to the cartridge sleeve of the cartridge of FIG. 4, according to embodiments of the disclosure.

FIG. 4C shows the cartridge sleeve 44 may have a first inner cartridge diameter D3 smaller in size than a second cartridge diameter D4. This may result in the presence of a working surface 51 within the sleeve 44. The difference between diameters D3 and D4 may provide or create a hydraulic imbalance across the sleeve 44. Fluid pressure acting on the working surface 51 may help keep the spring 46 compressed.

Figure 5:
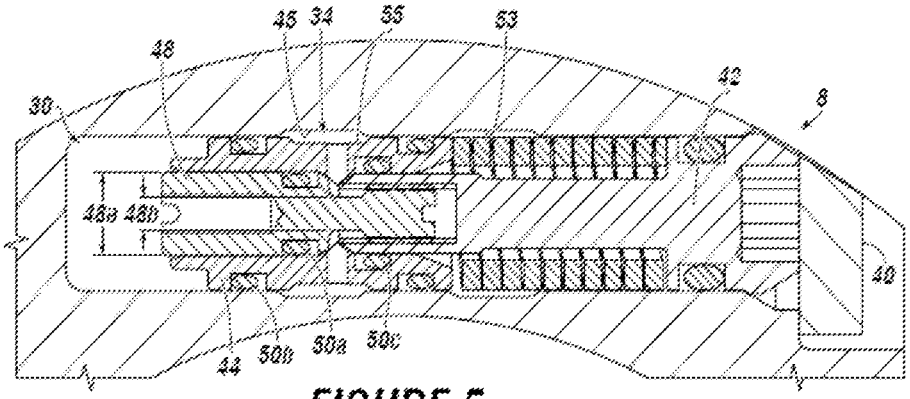
FIG. 5 shows a detailed cross-sectional side view of the upper sub with one cartridge, in a run-in position, according to embodiments of the disclosure.

With reference now to FIG. 5, it may be seen that the cartridge 8 (or as part of valve assembly 11, FIG. 2A) may insert within the cartridge bore 30 in a manner to form the pressure chamber 34. The pressure chamber 34 may be the void or space between a first bore recess 45 and a pin recess 55. Fluid may flow or be introduced into the pressure chamber 34, whereby two hydraulic active areas are created that act against the two atmospheric chambers (36 and 38, FIG. 3).

The first hydraulic active area may be generated by the seal 50A installed on the break pin 48 in a manner to sealingly engage the break pin 48 outside diameter (or outer pin surface) against an inside diameter (or inner sleeve surface) of the cartridge sleeve 44. The pressure on this hydraulic active area may place the break pin 48 in tension relative to the spring rod 42. This may occur as a result of the break pin 48 being engaged with the spring rod 42, and the spring rod 42 may be held in place by the retention plate 40. This diameter 48A may define the magnitude of the hydraulic imbalance and the force load that tries to break the break pin 48. This force need not impinge upon the cartridge sleeve 44.

The second hydraulic active area is generated by a difference between the seal 50A and the seal 50C installed inside the cartridge sleeve 44 sealing on the spring rod 42. Together the diameter 48A and break diameter 48B, these hydraulic imbalance diameters may result or create an axial load acting on the cartridge sleeve 44 in the direction needed to prevent the spring from decompressing (compare to spring decompression in FIG. 7).

Figure 6:
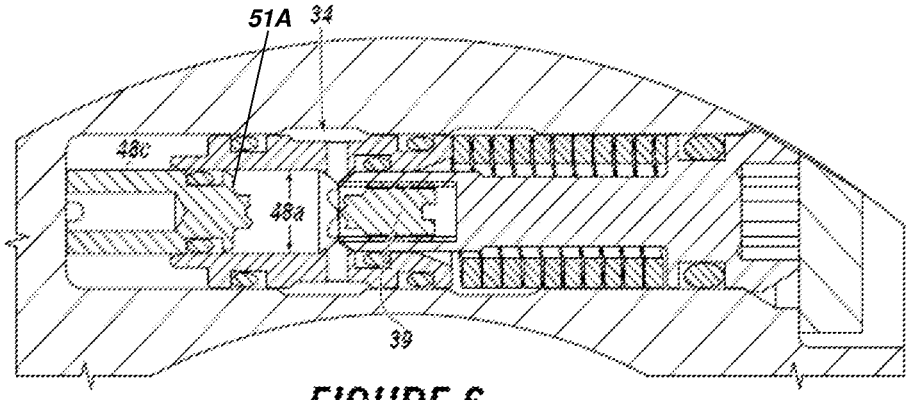
FIG. 6 shows a detailed cross-sectional side view of the upper sub with one cartridge, showing the break pin in a sheared condition, according to embodiments of the disclosure.

With reference now to FIG. 6, when a pressure is applied against the break pin seal diameter 48A by acting on pin working surface 51A, the pin 48 may break at the break diameter 48B. The break of the pin 48 may result in one part of pin head 39 left engaged into or with the spring rod 42, and another pin portion 48C movable within the break pin atmospheric chamber 36. The break may occur while still maintaining a positive seal inside the cartridge sleeve 44. With the break pin 48 now broken, the break pin 48 may no longer abut cartridge sleeve 44 against spring 46. As such, only fluid pressure may hold the spring 46 in a compressed state at this point. The pressure at which the break pin breaks 48 may be adjustable and/or predetermined. This pressure may be sufficient to hold the spring 46 in compression by acting on the cartridge sleeve hydraulic imbalance during and the pin breakage.

When the break pin remnant 48C is in its resting position and the spring 46 is fully compressed, pressure inside the pressure chamber can be increased to a desired pressure for pressure testing. The hydraulic imbalance may be built into the cartridge sleeve by having diameter 48A (reference to 50A) larger than break diameter 48B diameter (reference to 50C) so as long as there is fluid pressure inside the pressure chamber the imbalance will exist. Varying the size of the hydraulic imbalance and the fluid pressure may control the force load acting on the spring 46 at the time of pin breakage to be greater than the spring preload value.

Figure 7:
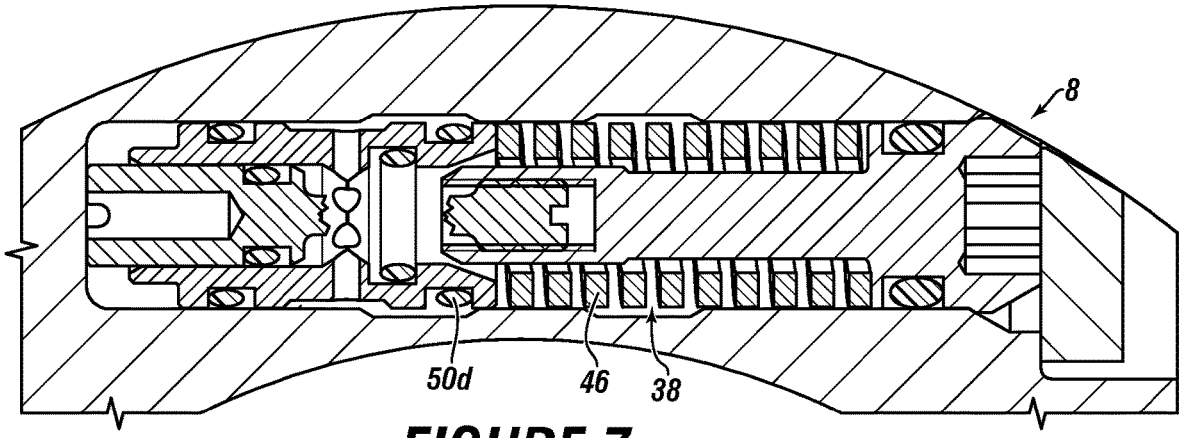
FIG. 7 shows a detailed cross-sectional side view of the upper sub with one cartridge, in a spring partially expanded position, according to embodiments of the disclosure.
Figure 8:
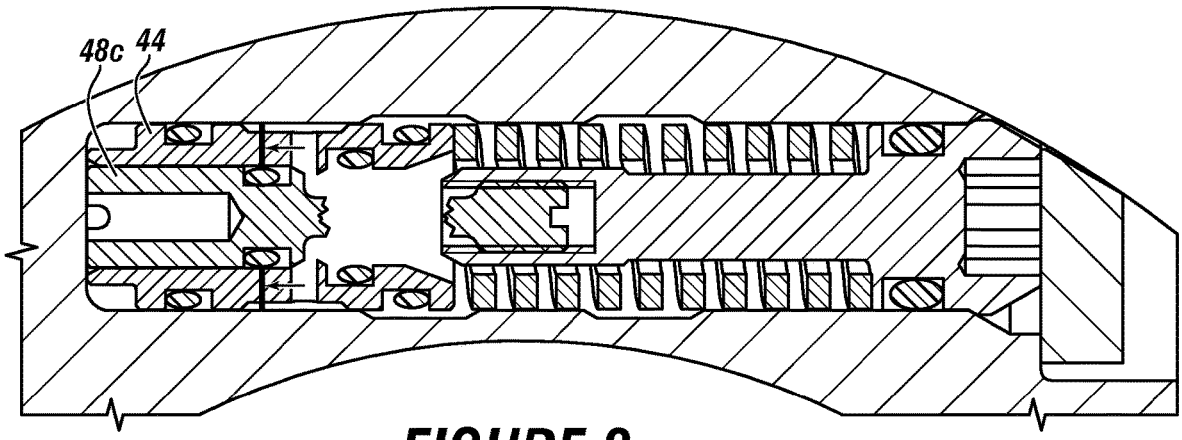
FIG. 8 shows a detailed cross-sectional side view of the upper sub with one cartridge, in a spring fully expanded position, according to embodiments of the disclosure.

With reference now to FIGS. 7 and 8 together, maintaining a high-pressure (or desired pressure) value inside the pressure chamber (34, FIG. 6) may provide the cartridge 8 with ability to keep or hold the spring 46 in a compressed or biased state. In turn, reducing the pressure to a controlled value may allow the bias of the spring 46 to push or otherwise urge the cartridge sleeve 44 over the break pin 48 (or portion 48C). Seal 50D that had previously isolated the spring atmospheric chamber 38 from the pressure chamber 34 may now shift to unseal and permit pressurized fluid to migrate into the spring atmospheric chamber 38.

With reference specifically to FIG. 8, once the fluid has been released from the pressurized chamber (34) into the spring atmospheric chamber 38 the increased hydraulic area created against the break pin atmospheric chamber 36 will trigger, in conjunction with the spring force, a push of the cartridge sleeve 44 into a fully moved (retracted) position shown here, thus allowing the fluid bypass to be easily maximized. Fluid may now travel or flow freely through the spring atmospheric chamber 38 into either a pressure chamber 34 of a subsequent stage, where the cycle shown in FIGS. 5 to 8 may be repeated, or if the stage is the last stage, fluid may flow into the upper atmospheric chamber 14 on an uphole side of the piston valve (10, FIG. 1). Although some embodiments shown illustrate two stages, the number of stages can vary from only one to more than two without any consequential difference in the form, fit and function of the mechanism described. In embodiments, there may be about 1 stage to about 20 stages.

Figure 9:
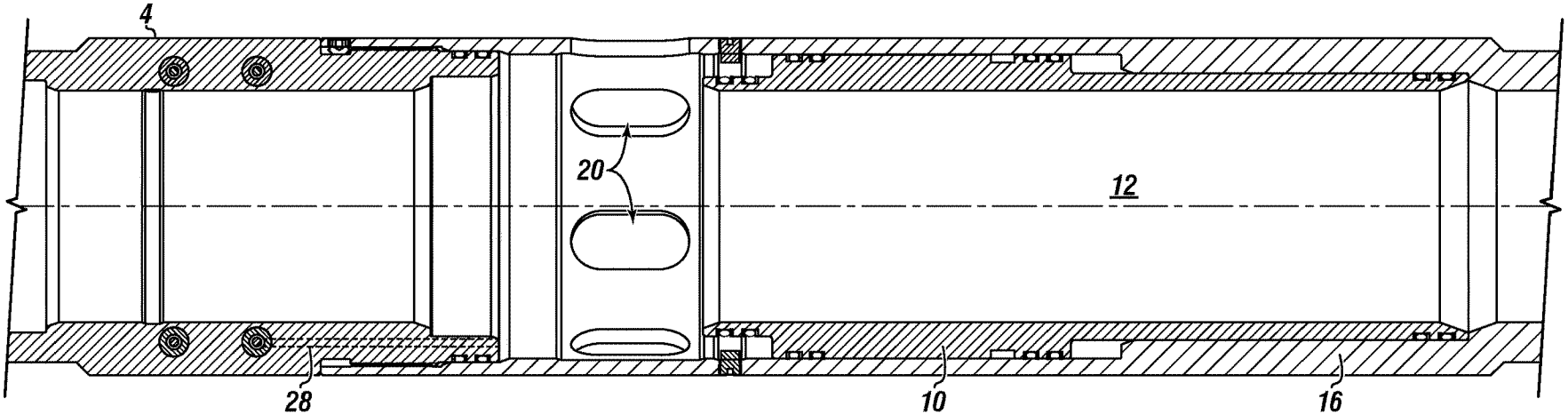
FIG. 9 shows a cross-sectional elevation view of the initiator sleeve of FIG. 1, in a sleeve opened position, according to embodiments of the disclosure.
Figure 10A:
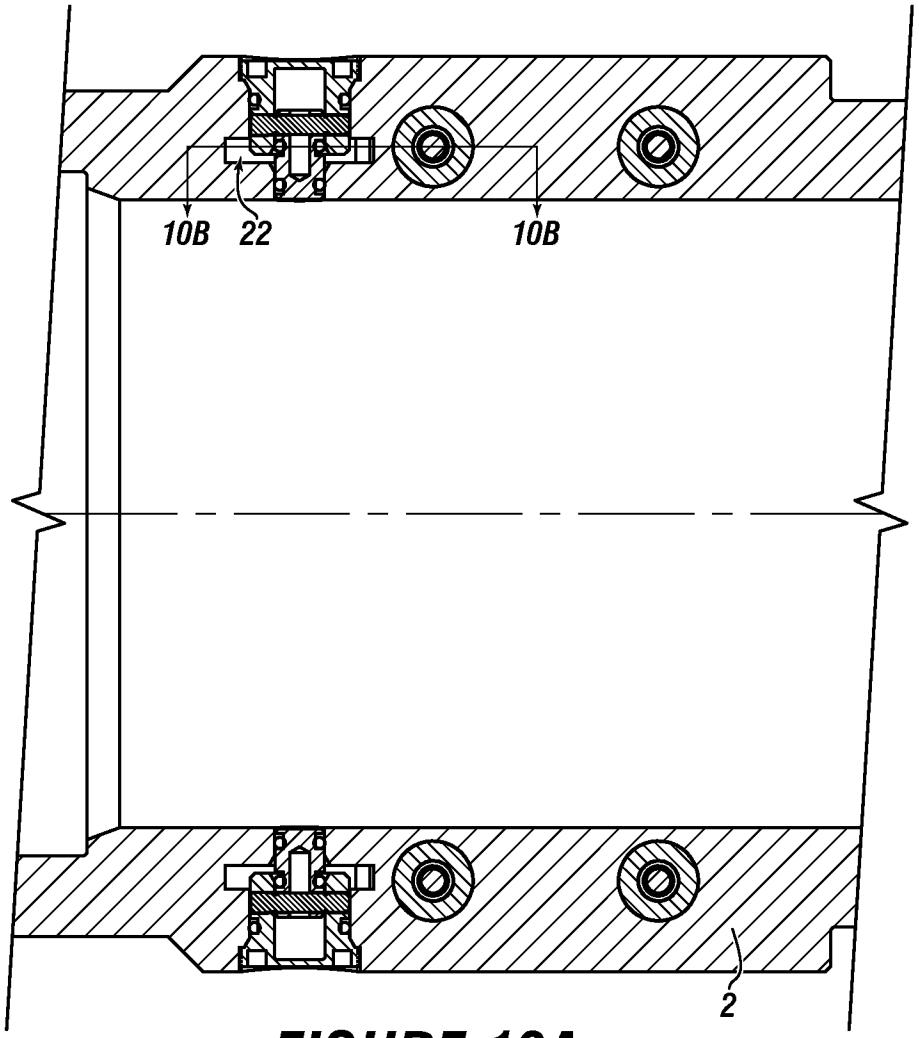
FIG. 10A shows a detailed cross-sectional view of an upper sub of an initiator sleeve, according to embodiments of the disclosure.
Figure 10B:
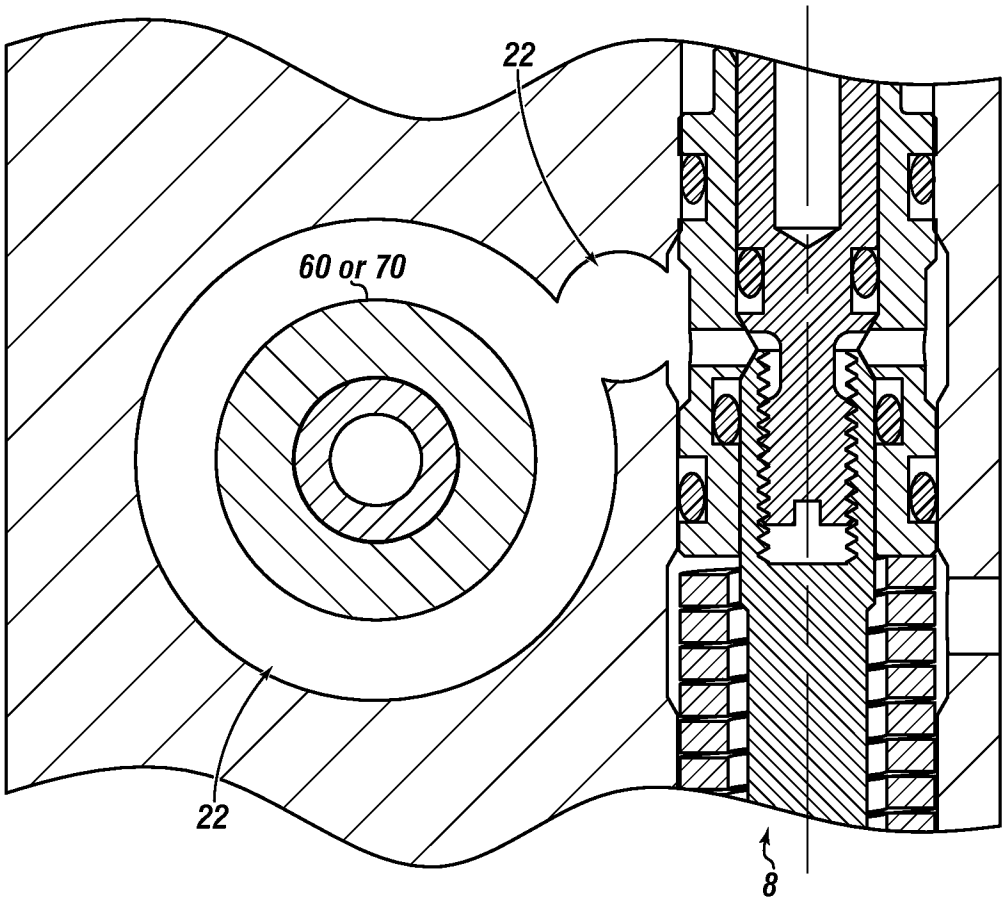
FIG. 10B shows a view of FIG. 10A, taken long line 10B, according to embodiments of the disclosure.

Now referring to FIG. 9, a sleeve-opened position of a sleeve tool, in accordance with embodiments herein, is shown. FIG. 1 originally shows the piston valve 10, which may initially be closed via one or more sheer screws 18 coupled therewith, may be hydraulically balanced. As such, the piston valve 10 may not move when fluid or down-hole tools are pumped through the inside bore 12 of the sleeve. However, when the valve assembly (11) of the upper atmospheric chamber 14 is filled with pressurized fluid, the pressure may eventually be communicated through outlet port 28. There may thus be a hydraulic imbalance may be created against the lower atmospheric chamber 16. This imbalance may ultimately result in the shearing of the shear screws 18, and subsequent movement of the piston valve 10 into its open position shown in FIG. 9. This results in the opening of the sleeve ports 20 between the inside 12 and the outside of the sleeve.

Referring now FIGS. 10A to 14 together, two alternate embodiments for the (temporary) plugging of a first communication port 22 of a cartridge 8, in accordance with embodiments herein, are shown. FIGS. 10A to 14 show one or more mechanism(s) that may open the flow path through the port 22 at a predetermined pressure value(s). This may be useful to prevent undesired plugging, such as from cement migrating into this port while cementing the well.

Figure 11A:
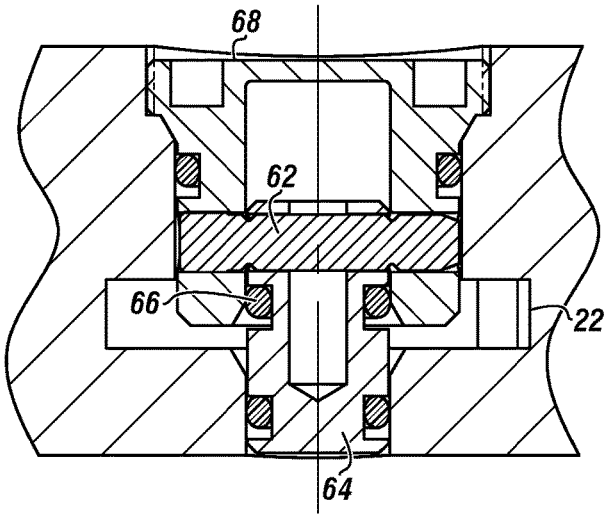
FIG. 11A shows a further detailed cross-sectional view of a shear pin of FIG. 10; showing the shear piston extended, according to embodiments of the disclosure.
Figure 11B:
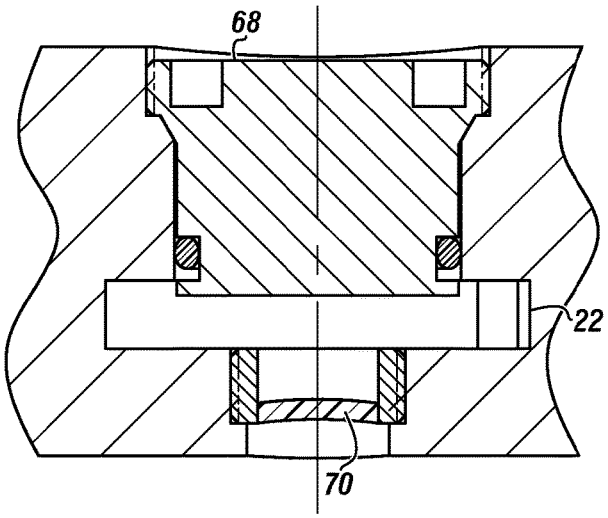
FIG. 11B shows an upper sub with a rupture disk, according to embodiments of the disclosure.

In the embodiments presented, fluid inside the toe initiator sleeve 2 may be prevented from accessing the first communication port 22 either by plugging it with plug device, such as a shear mechanism 60 or by the use of a rupture disk 70 (such as seen in FIG. 11B). The plug device may be configured and sized to break at desired pressure values above known threshold, such as the absolute cementing pressure. Once breached, the plug device (60, 70) may now allow fluid into the pressure chamber 34 of the first stage.

Figure 12:
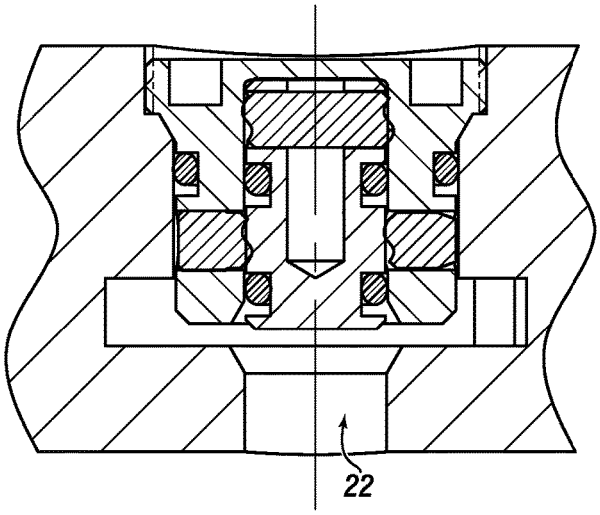
FIG. 12 shows a detailed cross-sectional view of the shear pin of FIG. 10, showing the shear piston retracted, according to embodiments of the disclosure.
Figure 14:
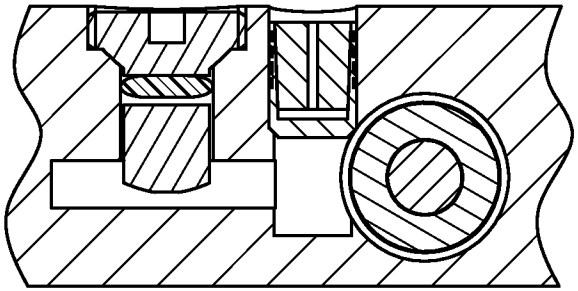
FIG. 14 shows a detailed cross-sectional side view of an upper sub of an initiator sleeve, according to embodiments of the disclosure.
Figure 13:
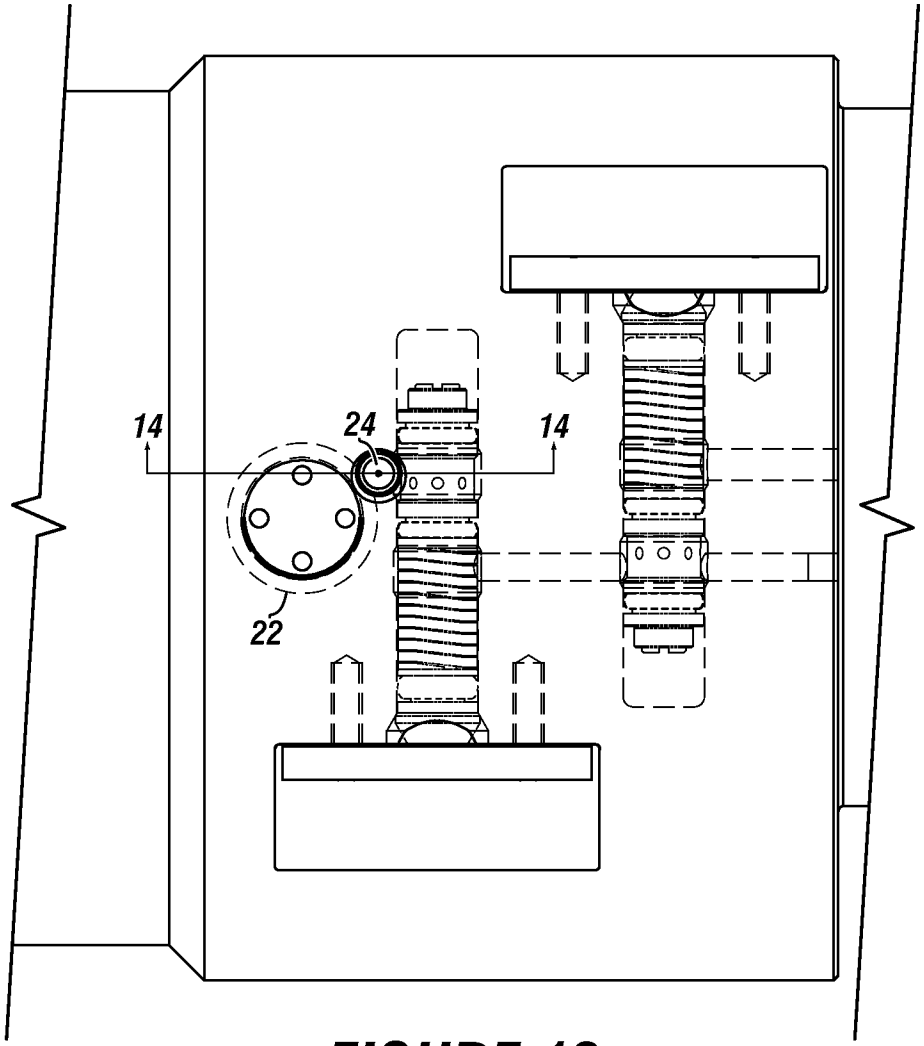
FIG. 13 shows a detailed cross-sectional top view of the upper sub of FIG. 10.
Figure 15:
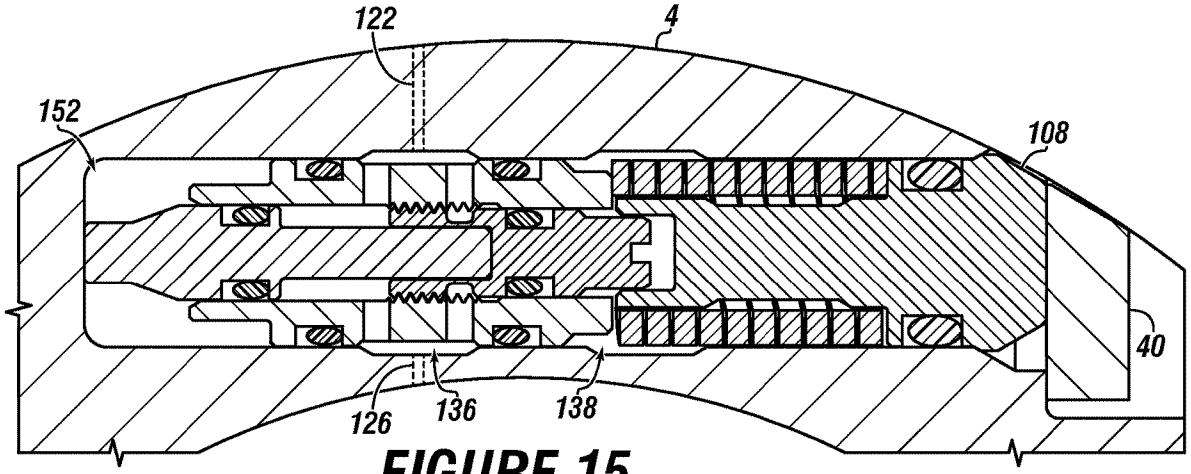
FIG. 15 shows a detailed cross-sectional elevation view of an upper sub with a further embodiment of a cartridge, in a run-in position, according to embodiments of the disclosure.
Figure 16A:
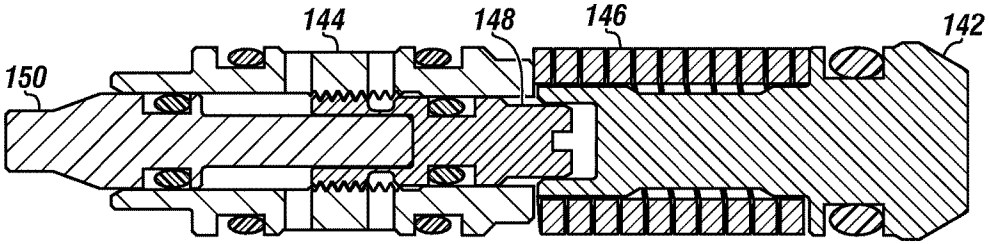
FIG. 16A shows a cross-sectional elevation view of a further embodiment of a cartridge, according to embodiments of the disclosure.
Figure 16B:
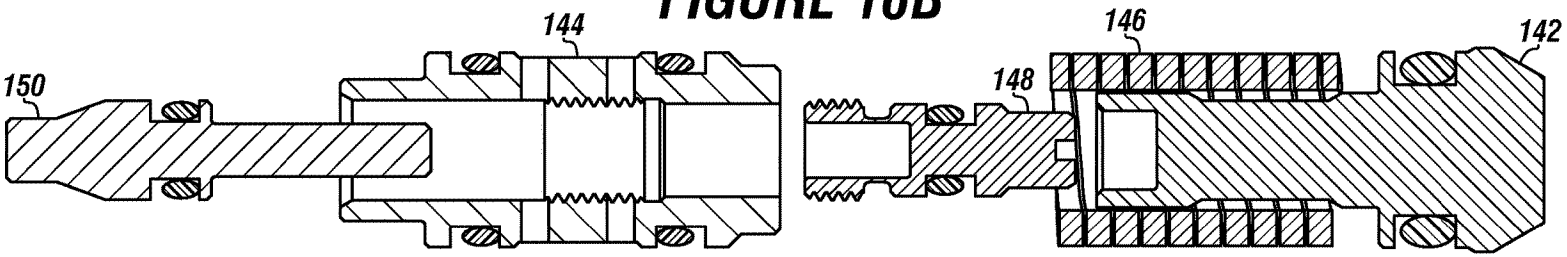
FIG. 16B shows a detailed cross-sectional elevation view of the components of the cartridge of the cartridge sleeve of FIG. 16A, according to embodiments of the disclosure.

The shear mechanism 60 may include a shear pin 62 and a shear piston 64, such as shown in FIG. 11A. The shear pin 62 may prevent the shear piston 64 from moving into a pin receptacle or holder 68 as long as the fluid inside the toe initiator sleeve 2 does not exceed a predetermined value. The activation (shear, break, etc.) value may be adjusted and/or pre-determined for different applications. Regardless of what plug device may be used, activation may occur. For example, when the predetermined pressure value reaches the shear pin 62 shear point, the shear pin 62 may shear, thereby allowing the sheared pin and shear piston 64 to be displaced inside the holder 68, as seen in FIG. 12. This results in the first communication port 22 being opened, and fluid communication established.

A seal 66 may be disposed between the shear piston 64 and the pin holder 68. The seal 66 may sealingly ensure that the piston 64 remains inside the holder 68 while multiple pressure cycles are applied to the hydraulic valving assembly, without hindrance.

With reference to FIGS. 15 to 18 together, a cartridge 108 having an alternative configuration, in accordance with embodiments herein, are shown. Cartridge 108 may work on or via similar principles as previously described for cartridge 8. While it need not be exactly the same, initiator sleeve 102 with cartridge 108 may include various features and components like that of other systems or tools described herein, and thus components thereof may be duplicate or analogous, and thus may not be described in detail and/or only in brevity, if at all.

As shown here, in embodiments the cartridge 108 may include an additional break pin rod 150. The break pin rod 150 may be held (axially) in place within a break pin rod atmospheric chamber 152. The break pin 148 is threaded directly into cartridge sleeve 144 at one end while the second end is axially moveable within the spring rod 142.

Figure 17A:
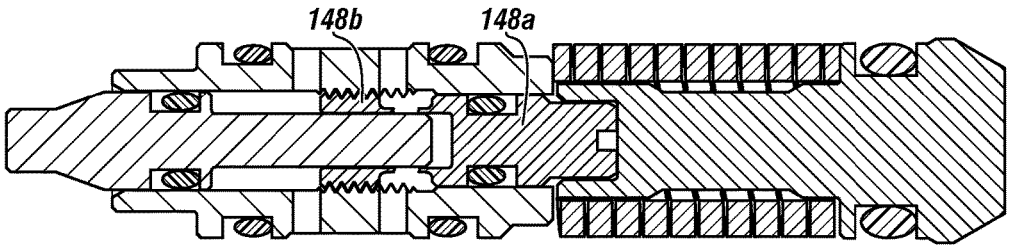
FIG. 17A shows a detailed cross-sectional elevation view of the cartridge of FIG. 15, in a broken configuration, according to embodiments of the disclosure.
Figure 17B:
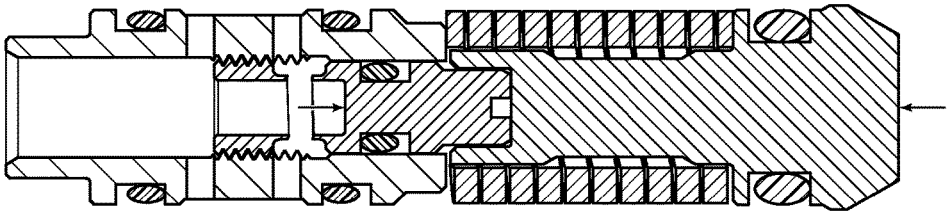
FIG. 17B shows a further detailed view of the cartridge of FIG. 17A, according to embodiments of the disclosure.
Figure 17C:
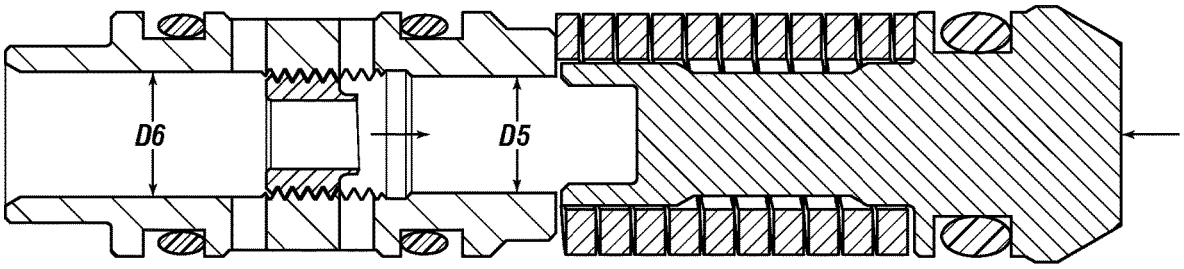
FIG. 17C shows a further detailed view of the cartridge of FIG. 17A, according to embodiments of the disclosure.

When the break pin 148 breaks due to force (such as via hydraulic pressure), one portion of the break pin 148A moves towards the spring rod 142 and a second portion 148B remains threaded to the cartridge sleeve 144 (see FIG. 17A). Once the break pin 148 is broken, a pressure test may be performed, as a fluid communication path may be established through the cartridge 108. The pressure applied via the test cycle or otherwise may be sufficient to keep a bias member, such as spring 146, in an energized or biased (such as compressed state).

Figure 18:
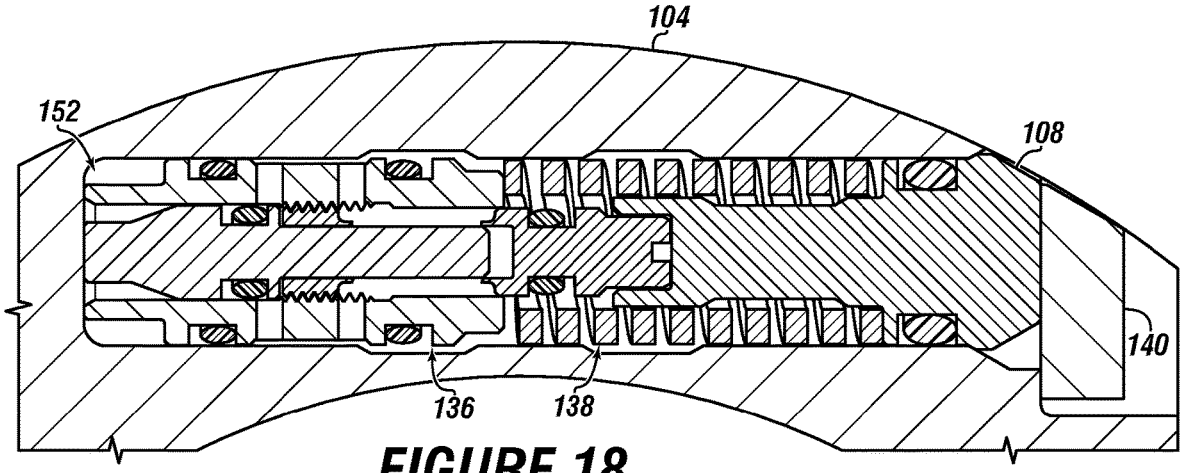
FIG. 18 shows a further detailed view of the cartridge of FIG. 17A, in a fully expanded position, according to embodiments of the disclosure.

When the pressure test is completed, reducing the pressure to a controlled minimum or predetermined value may provide for the spring 146 to push the cartridge sleeve 144 over the break pin rod 150 (see FIG. 18). Seals that had previously isolated a spring atmospheric chamber 138 from a pressure chamber 134 are now shifted to unseal and permit the pressurized fluid to migrate into the spring atmospheric chamber 138.

The increased hydraulic area (compare smaller inner diameter D5 to larger inner diameter D6), in conjunction with the spring force, a push of the cartridge sleeve 144 into a fully retracted position, thus allowing the fluid bypass to be easily maximized. The fluid may now flow or communicate freely through the spring atmospheric chamber 138 into either a pressure chamber 34/134 of a subsequent stage, or if the stage is the last stage, fluid will flow into the upper atmospheric chamber (see 14, FIG. 1) on an uphole side of the piston valve (10).

Figure 19A:
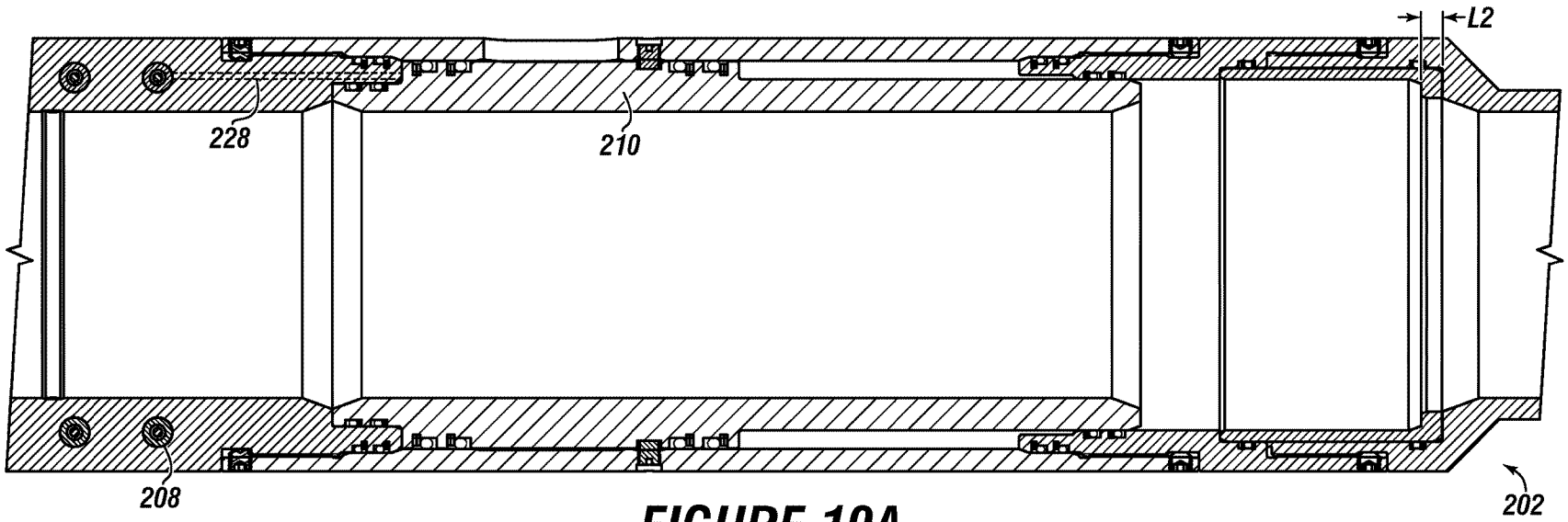
FIG. 19A shows a longitudinal cross-sectional view of a downhole tool sleeve configured with a flow control insert, according to embodiments of the disclosure.
Figure 19B:
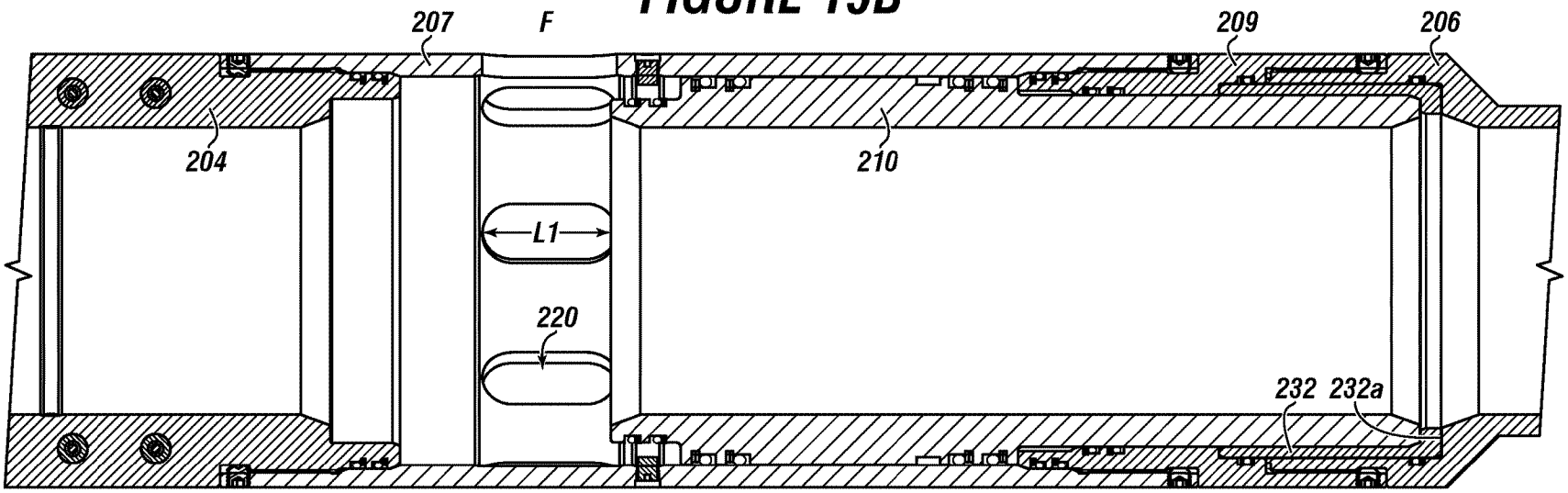
FIG. 19B shows a longitudinal cross-sectional view of the downhole tool sleeve of FIG. 19A with sleeve ports unblocked, according to embodiments of the disclosure.
Figure 19C:
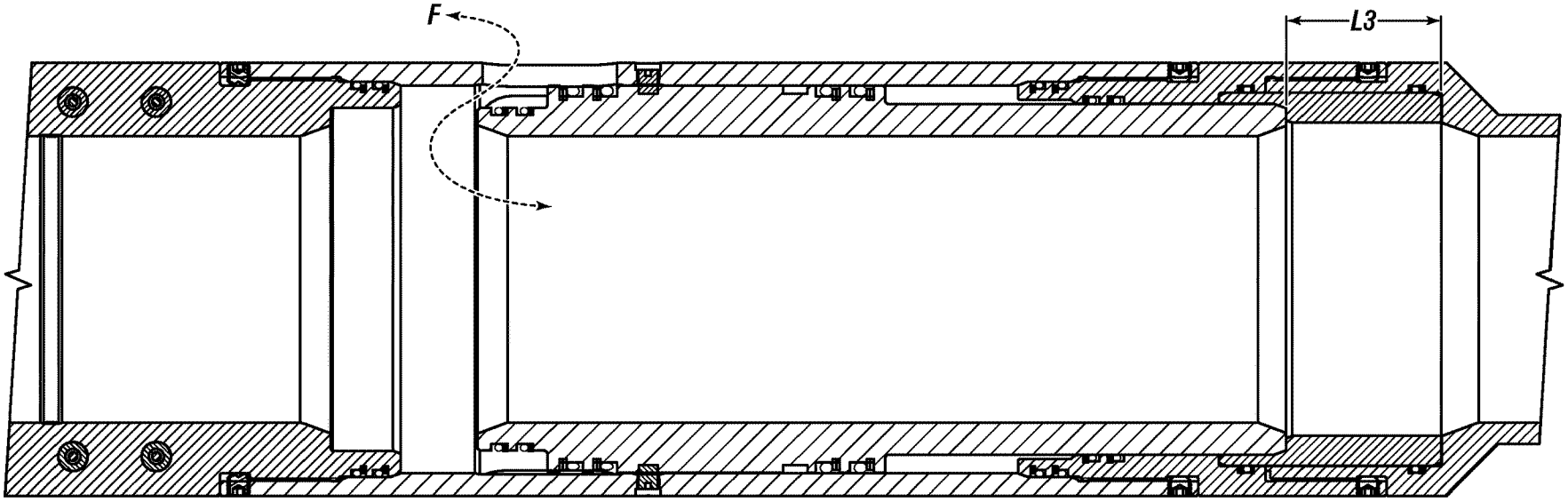
FIG. 19C shows a longitudinal cross-sectional view of the downhole tool sleeve having a flow control insert with one or more sleeve ports partially blocked by a piston valve, according to embodiments of the disclosure.

Referring now to FIGS. 19A, 19B, and 19C, a longitudinal cross-sectional view of a downhole tool sleeve configured with a flow control insert, a longitudinal cross-sectional view of the downhole tool sleeve with sleeve ports fully unblocked, and a longitudinal cross-sectional view of the downhole tool sleeve having a flow control insert with one or more sleeve ports partially blocked by a piston valve, in accordance with embodiments herein, are shown.

While it need not be exactly the same, initiator sleeve 202 with cartridge 208 may include various features and components like that of other systems or tools described herein, and thus components thereof may be duplicate or analogous, and thus may not be described in detail and/or only in brevity, if at all.

The downhole sleeve tool 202 may have an upper sub 204 and lower sub 206. The lower sub 206 may have one or more sleeve ports 220 to facilitate flow into and/or out of the sleeve tool 202. As shown here, there may be one or more intermediary or housings or subs 207, 209, any of which may additionally or alternatively have one or more sleeve ports 220. The subs 204, 206, 207, and/or 209 may be engaged with a respective proximate sub. Engagement may be threadingly, securingly, and so forth.

The upper sub 204 may have an at least one cartridge assembly 208 according to any embodiment herein. As such, the cartridge assembly 208 may be configured to control flow through the tool 202. Upon activation, fluid may flow through the cartridge assembly, through outlet port 228, and against a piston valve 210.

The piston valve 210 may be held in place via one or more shear screws or the like. Provided a sufficient amount of force is applied, the one or more shear screws may shear, and the piston valve 210 may slide or otherwise be urged from a closed position (FIG. 19A) to an open position (19B/19C). 19B illustrates a generally full open position, such that the slots (and entire length L1 or opening) are unblocked. Of note, the sleeve 202 may have a flow control insert 232 disposed therein.

The insert 232 may be an annular sleeve body, and be disposed within (at least partially) the lower sub 206. The insert 232 may have an annular ridge 232A, which may extend radially inward. Accordingly, when the piston valve 210 moves open, an end 210A of the valve 210 may engage or otherwise come to rest against the annular ridge 232A. The annular ridge 232A may have a longitudinal height or length L2. The length L2 may be modified or adjusted to accommodate a proportional amount of desired movement of the valve 210.

For example, FIG. 19C shows a larger length L3 that results in the valve 210 only moving far enough to yet still partially block the ports 220. This may result in reduced or throttled flow of fluid F through the sleeve 202.

Advantages

Embodiments of the disclosure may provide for compact downhole sleeve tool design capable of withstanding high pressures and temperatures in a small envelope (large inside dia. and small outside dia.). This means there may be a "two-layered" sleeve design, which may provide for an essential feature.

Embodiments herein may provide for a modular design allows for fast set-up changes. The pressure cartridges may easily be accessible and interchanged without having to remove any major component(s). The upper (or top) and lower (or bottom) subs may be replaced without affecting any of the atmospheric chambers.

Other advantages provide for a frac port opening that may be adjusted without difficulty to vary from matching the sleeve ID to the desired restricted size.

The piston valve may be beneficially kept form prematurely opening (on top of members coupling it to the housing) by a force imbalance generated by simply exposing the sleeve to internal pressure. As such, a positive force (proportional with the internal pressure) across this component is biasing the sleeve closed.

Embodiments herein may provide for Short and compact design due to the tangential (or orthogonal, perpendicular, offset, etc.) orientation of the cartridge/stage bores. There may be a sufficient number of pressure cartridge capable of a large number of set-ups to match the customer requirements.

While preferred embodiments of the disclosure have been shown and described, modifications thereof can be made by one skilled in the art without departing from the spirit and teachings of the disclosure. The embodiments described herein are exemplary only, and are not intended to be limiting. Many variations and modifications of the disclosure disclosed herein are possible and are within the scope of the disclosure. Where numerical ranges or limitations are expressly stated, such express ranges or limitations should be understood to include iterative ranges or limitations of like magnitude falling within the expressly stated ranges or limitations. The use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, and the like.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the preferred embodiments of the present disclosure. The inclusion or discussion of a reference is not an admission that it is prior art to the present disclosure, especially any reference that may have a publication date after the priority date of this application. The disclosures of all patents, patent applications, and publications cited herein are hereby incorporated by reference, to the extent they provide background knowledge; or exemplary, procedural or other details supplementary to those set forth herein.

What is claimed is:

1. A downhole sleeve tool comprising:

a lower sub comprising a central bore therethrough and an at least one sleeve port;

a piston valve slidably positionable within the lower sub to selectively block fluid communication between the central bore and the one or more sleeve ports;

an upper sub connectable to the lower sub, the upper sub further comprising:

an inlet port;

an at least one fluid communication port;

an outlet port; and a cartridge bore formed within a sidewall of the upper sub;

a cartridge assembly disposed within the cartridge bore, the cartridge assembly further comprising:

a spring rod;

a cartridge sleeve movably positioned on an at least a portion of the spring rod;

a bias member engaged with the cartridge sleeve;

a break pin comprising a pin working surface, the break pin disposed within at least a portion of the cartridge sleeve, and engaged with the spring rod, wherein the break pin is configured to break from application of a pressure of a fluid against the pin working surface.

2. The downhole sleeve tool of claim 1, wherein the downhole sleeve tool further comprises a second cartridge assembly, and wherein the fluid enters the second cartridge assembly after the bias member moves the cartridge sleeve to a retracted position.

3. The downhole sleeve tool of claim 2, wherein at least one of the cartridge assembly and the second cartridge assembly have a longitudinal cartridge axis, wherein the downhole sleeve tool has a longitudinal sleeve axis, and wherein the longitudinal cartridge axis is orthogonal to the longitudinal sleeve axis.

4. The downhole sleeve tool of claim 1, the downhole sleeve tool further comprising a flow control insert.

5. The downhole sleeve tool of claim 4, wherein the flow control insert comprises an inner radial ridge, and wherein the inner radial ridge comprises a longitudinal ridge height.

6. The downhole sleeve tool of claim 5, wherein a portion of the piston valve is configured to at least partially block the at least one sleeve port when an end of the piston valve is engaged with an end of the inner radial ridge.

7. The downhole sleeve tool of claim 6, wherein a blocking ratio of the longitudinal ridge height to a height of the portion is in a ratio range of 0.8 to 1.2.

8. The downhole sleeve tool of claim 1, the tool further comprising an upper atmospheric chamber proximate an uphole end of the piston valve, wherein the upper atmospheric chamber is in fluid communication with the outlet port.

9. The downhole sleeve tool of claim 8, wherein the piston valve is hydraulically balanced until the upper atmospheric chamber is pressurized with the fluid transferred from the outlet port.

10. The downhole sleeve tool of claim 1, the fluid enters a pressure chamber of the cartridge from the inlet port in order to act on the pin working surface.

11. The downhole sleeve tool of claim 1, wherein the pressure chamber is sealingly isolated from fluid communication with any other part of the cartridge bore until the break pin breaks.

12. The downhole sleeve tool of claim 11, wherein release or reduction of fluid pressure in the pressure chamber allows extension of the bias member and resultant movement of the cartridge sleeve to a retracted position.

13. The downhole sleeve tool of claim 12, wherein movement of the cartridge sleeve facilitates the shift of one or more seals between the pressure chamber and a spring atmospheric chamber to thereby allow fluid flow from the pressure chamber to the spring atmospheric chamber, and then to at least one of: a subsequent cartridge assemblies via a communications port, and to the uphole end of the piston valve.

14. The downhole sleeve tool of claim 1, further comprising a retention plate to axially fix the spring rod in the cartridge assembly.

15. The downhole sleeve tool of claim 1 wherein the break pin is formed with a break diameter at which it breaks, and wherein the break pin threadingly engaged to the spring rod in an assembled, unactivated configuration.

16. The downhole sleeve tool of claim 15, wherein upon breakage of the break pin, a first break pin remnant remains threadingly engaged with the spring rod and a second break pin remnant and the cartridge sleeve are slidingly movable into a break pin atmospheric chamber, and wherein one or more seals on the cartridge sleeve prevent fluid pressure from entering break pin atmospheric chamber.

17. A method of opening a downhole sleeve tool, said method comprising the steps of:

providing a downhole sleeve tool comprising:

a lower sub comprising: a central bore, and at least one lateral sleeve port;

a piston valve slidably positionable within the lower sub to selectively block fluid communication between the central bore and the at least one sleeve port;

an upper sub engaged with the lower sub, the upper sub comprising: an inlet port, an at least one communication port, an outlet port, and a cartridge bore formed in a sidewall of the upper sub;

a cartridge assembly disposed and housed within the cartridge bore, the cartridge assembly comprising: a spring rod; a cartridge sleeve slidably positioned on at least a portion of the spring rod; a bias member engaged with the cartridge sleeve in a biased position; a break pin disposed in at least a portion of the cartridge sleeve, and engaged with the spring rod;

pressurizing the cartridge bore in a sufficient manner to break the break pin with fluid pressure from the central bore;

releasing fluid pressure from the cartridge bore to release the bias member from the biased position, and thereby allow the bias member to move the cartridge sleeve to a retracted position;

after the releasing step, allowing passage of fluid from the cartridge bore to an at least one of: one or more subsequent cartridge assemblies via a communications port, and to an uphole end of the piston valve to thereby shift the piston valve away from selectively blocking the sleeve port in order to allow fluid communication between the central bore and the at least one sleeve port.

18. A downhole sleeve tool comprising:

a lower sub defining a central bore and one or more sleeve ports therethrough;

a piston valve slidably positionable within the lower sub to selectively block fluid communication between the central bore and the one or more sleeve ports;

an upper sub connectable to the lower sub, the upper sub further comprising:

an inlet port;

an at least one fluid communication port;

an outlet port; and a cartridge bore formed within a sidewall of the upper sub;

a cartridge assembly disposed within the cartridge bore, the cartridge assembly further comprising:

a spring rod;

a cartridge sleeve movably positioned on at least a portion of the spring rod;

a bias member engaged with the cartridge sleeve;

a break pin disposed within at least a portion of the cartridge sleeve, and engaged with the spring rod, wherein breakage of the break pin by fluid pressure from the central bore and release of fluid pressure allows extension of the bias member and axial movement of the cartridge sleeve, allowing passage of fluid to one or more subsequent cartridge assemblies via a communications port, or allows passage of fluid to an uphole end of the piston valve to thereby shift the valve to allow communication between the central bore and the one or more sleeve ports.

19. The downhole sleeve tool of claim 18, wherein the cartridge assembly comprises a longitudinal cartridge axis, wherein the downhole sleeve tool has a longitudinal sleeve axis, and wherein the longitudinal cartridge axis is orthogonal to the longitudinal sleeve axis.

20. The downhole sleeve tool of claim 19, the downhole sleeve tool further comprising a flow control insert configured with an inner radial ridge having a longitudinal ridge height, and wherein a portion of the piston valve is configured to at least partially block the at least one sleeve port when an end of the piston valve is engaged with an end of the inner radial ridge.

* * * * *